US011666963B1

(12) United States Patent
Zarola

(10) Patent No.: US 11,666,963 B1
(45) Date of Patent: Jun. 6, 2023

(54) GUITAR STRING STRETCHING ASSEMBLY

(71) Applicant: Joseph Anthony Zarola, Wimberly, TX (US)

(72) Inventor: Joseph Anthony Zarola, Wimberly, TX (US)

( * ) Notice: Subject to any disclaimer, the term of this patent is extended or adjusted under 35 U.S.C. 154(b) by 0 days.

(21) Appl. No.: 18/086,177

(22) Filed: Dec. 21, 2022

(51) Int. Cl.
*G10D 3/10* (2006.01)
*B21F 9/00* (2006.01)

(52) U.S. Cl.
CPC ..... *B21F 9/002* (2013.01); *G10D 3/10* (2013.01)

(58) Field of Classification Search
CPC ..... G10D 3/10; B21F 9/002
See application file for complete search history.

(56) References Cited

U.S. PATENT DOCUMENTS

| | | | | |
|---|---|---|---|---|
| 881,269 | A * | 3/1908 | Van Houten | G10G 7/02 84/454 |
| 4,249,732 | A | 2/1981 | Balaban | |
| 4,445,964 | A * | 5/1984 | Nakamura | B29C 48/05 156/244.15 |
| 5,454,525 | A * | 10/1995 | Schamesberger | B65H 75/28 28/240 |
| 9,892,718 | B2 | 2/2018 | Lambert | |
| 9,940,910 | B1 * | 4/2018 | Stewart | G10D 3/14 |
| 10,395,626 | B1 * | 8/2019 | Stewart | G10D 3/00 |
| 10,818,275 | B2 * | 10/2020 | Ball | G10D 1/08 |
| 11,482,199 | B2 * | 10/2022 | Wunsch | G01L 5/047 |
| 11,554,930 | B2 * | 1/2023 | Kim | D07B 7/14 |
| 2002/0038596 | A1 * | 4/2002 | Lome | G10D 3/10 84/458 |
| 2019/0295511 | A1 * | 9/2019 | Ball | G10D 3/22 |
| 2021/0125587 | A1 | 4/2021 | Klanner | |
| 2022/0044657 | A1 | 2/2022 | Wunsch | |

* cited by examiner

*Primary Examiner* — Robert W Horn

(57) ABSTRACT

A instrument string stretching assembly for stretching instrument strings during the manufacturing process includes a curved panel that has a plurality of channels each extending through the curved panel. A plurality of instrument strings can be inserted into a respective one of the channels having each of the instrument strings extending outwardly through the respective channel. A stretching unit is aligned with each of the plurality of channels in the curved panel and the stretching unit is actuatable into a lifting condition or a lowering condition. A clamping unit is attached to the stretching unit to grip each of the plurality of instrument strings. The stretching unit lifts the clamping unit upwardly thereby stretching the instrument strings along the plurality of channels in the curved panel.

9 Claims, 7 Drawing Sheets

GUITAR STRING STRETCHING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to stretching devices and more particularly pertains to a new stretching device for stretching instrument strings during the manufacturing process. The device includes a curved panel that has a plurality of channels that extend longitudinally through the curved panel for receiving instrument strings. The device includes a stretching unit that is aligned with the curved panel and a clamping unit that is attached to the stretching unit. The clamping unit grips each of the instrument strings that have been extended through the channels in the curved panel. The stretching unit lifts the clamping unit to stretch the instrument strings in the channels.

(2) Description of Related Art Including Information Disclosed Under 37 CFR 1.97 and 1.98

The prior art relates to stretching devices including a racket stringing machine that includes a cam, a pivot arm attached to the cam and a gripping claw attached to the arm such that the gripping claw travels along an arc when the cam is rotated. The prior art discloses a method of conditioning a racquet string that includes spool that engages a length of string that is wound around a supply drum. The prior art discloses a restringing device that includes a guide chuck and a pair of mandrils. The prior art discloses a string stretching device that includes a pair of cylindrical members that are positionable between a instrument string and a fret board of a guitar. The prior art discloses a string stretching device that includes a clamp which engages a string and an actuator that engages the string to stretch the string between the actuator and the clamp. The prior art discloses a tension measuring device that includes a track, a clamp disposed in the track and a pulling unit movably disposed in the track for stretching a string between the clamp and the pulling unit.

BRIEF SUMMARY OF THE INVENTION

An embodiment of the disclosure meets the needs presented above by generally comprising a curved panel that has a plurality of channels each extending through the curved panel. A plurality of instrument strings can be inserted into a respective one of the channels having each of the instrument strings extending outwardly through the respective channel. A stretching unit is aligned with each of the plurality of channels in the curved panel and the stretching unit is actuatable into a lifting condition or a lowering condition. A clamping unit is attached to the stretching unit to grip each of the plurality of instrument strings. The stretching unit lifts the clamping unit upwardly thereby stretching the instrument strings along the plurality of channels in the curved panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
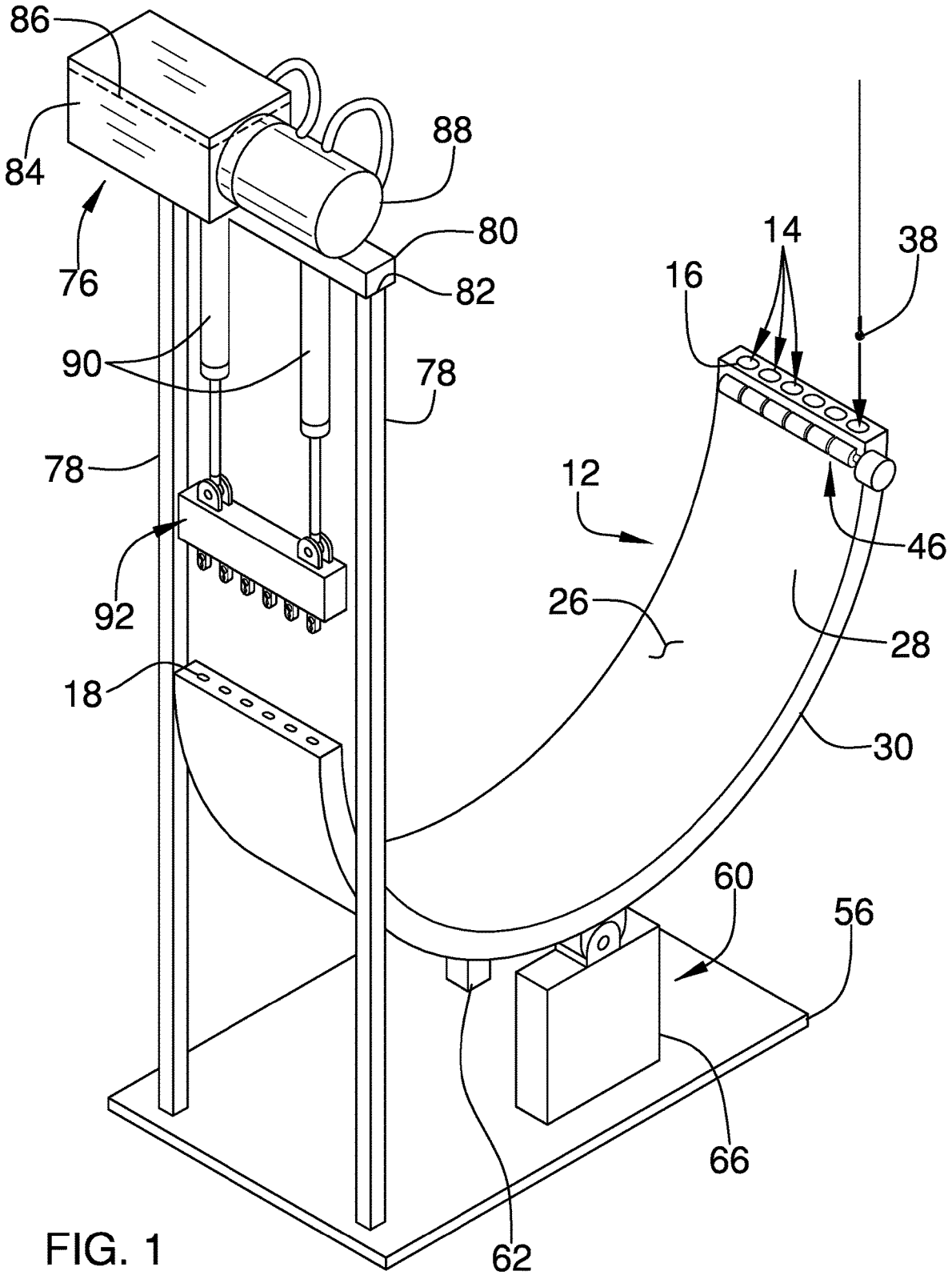
FIG. 1 is a perspective view of an instrument string stretching assembly according to an embodiment of the disclosure.
Figure 2:
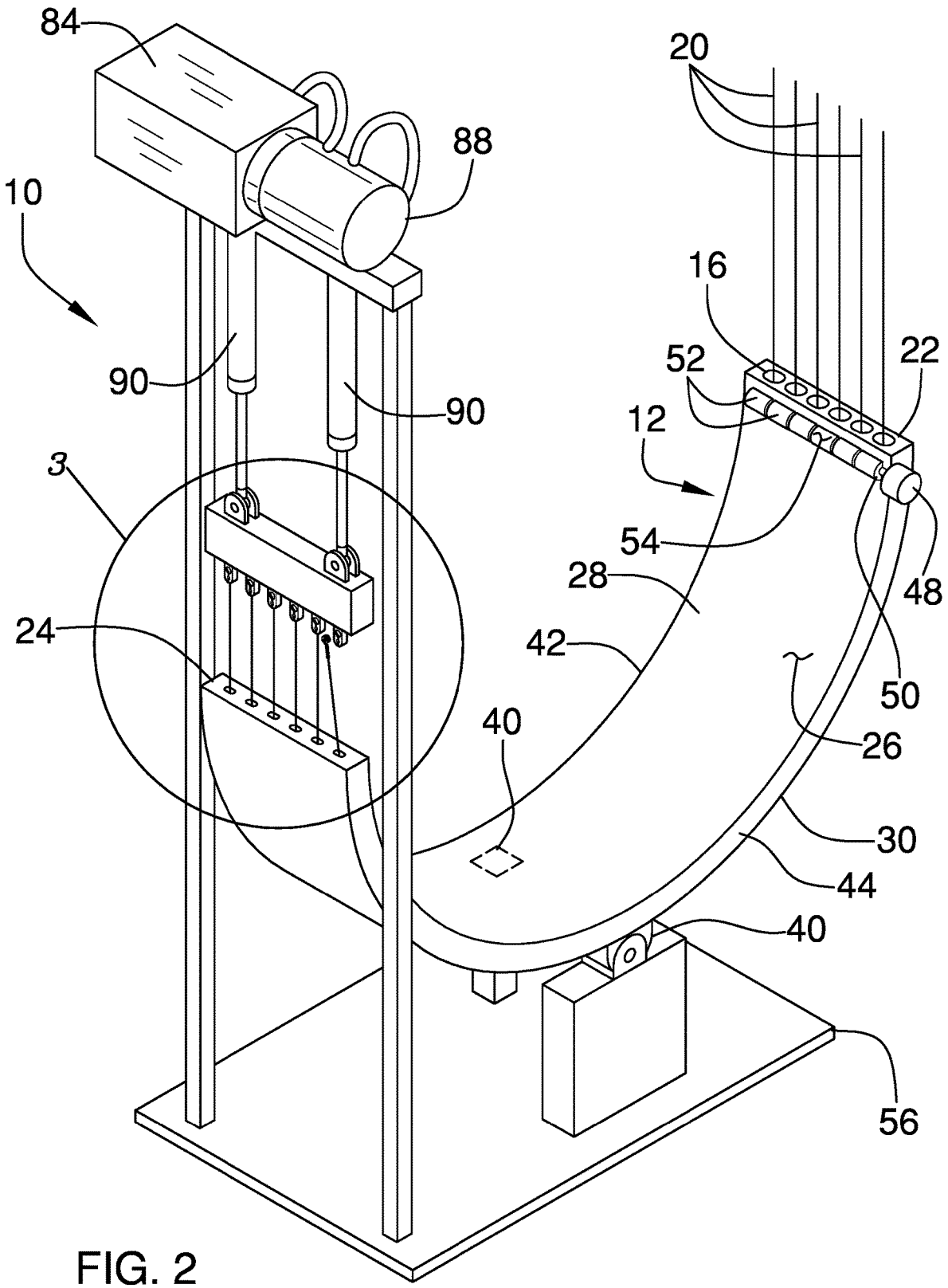
FIG. 2 is a perspective in-use view of an embodiment of the disclosure.
Figure 3:
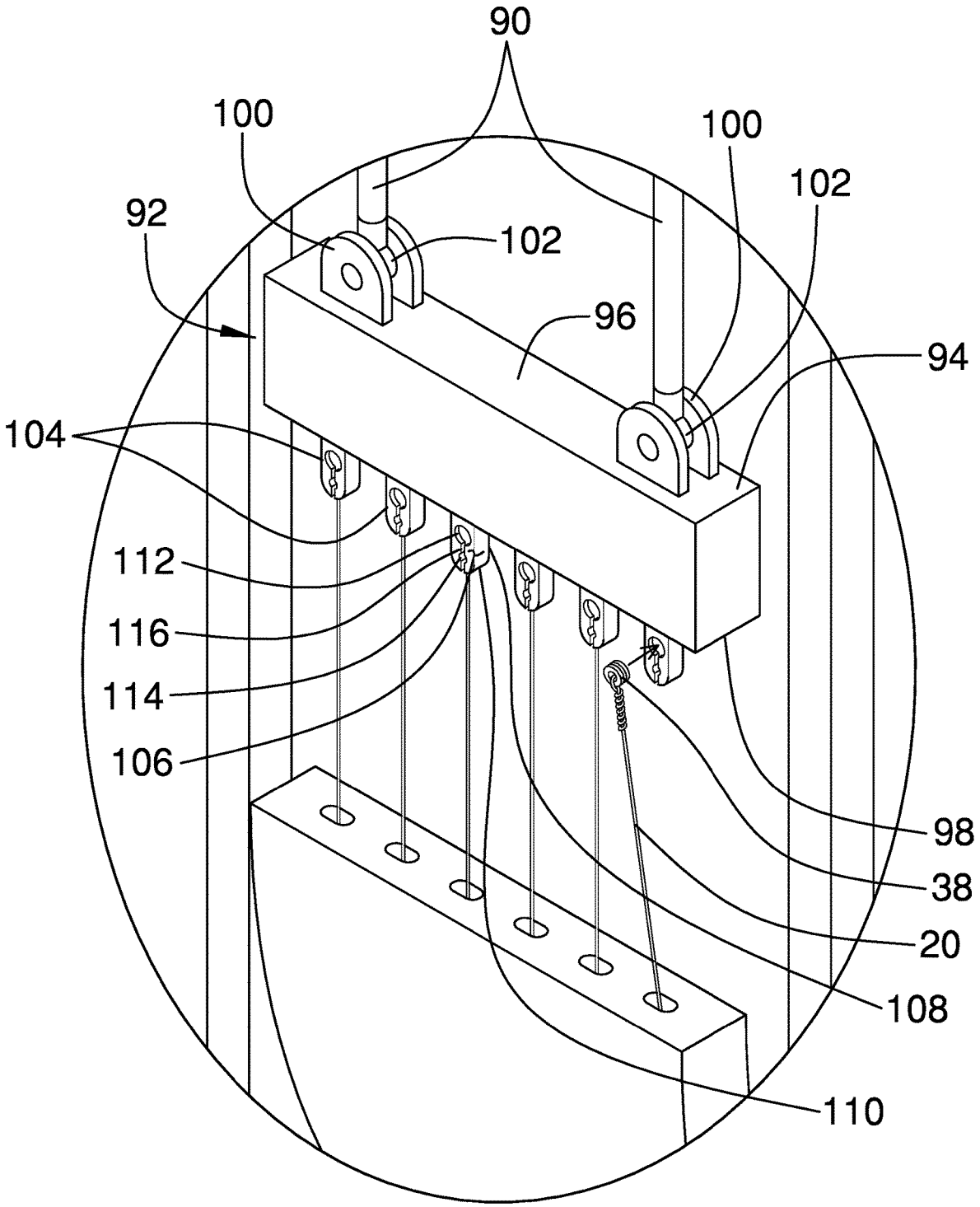
FIG. 3 is a detail view taken from circle 3 of FIG. 2 of an embodiment of the disclosure.
Figure 4:
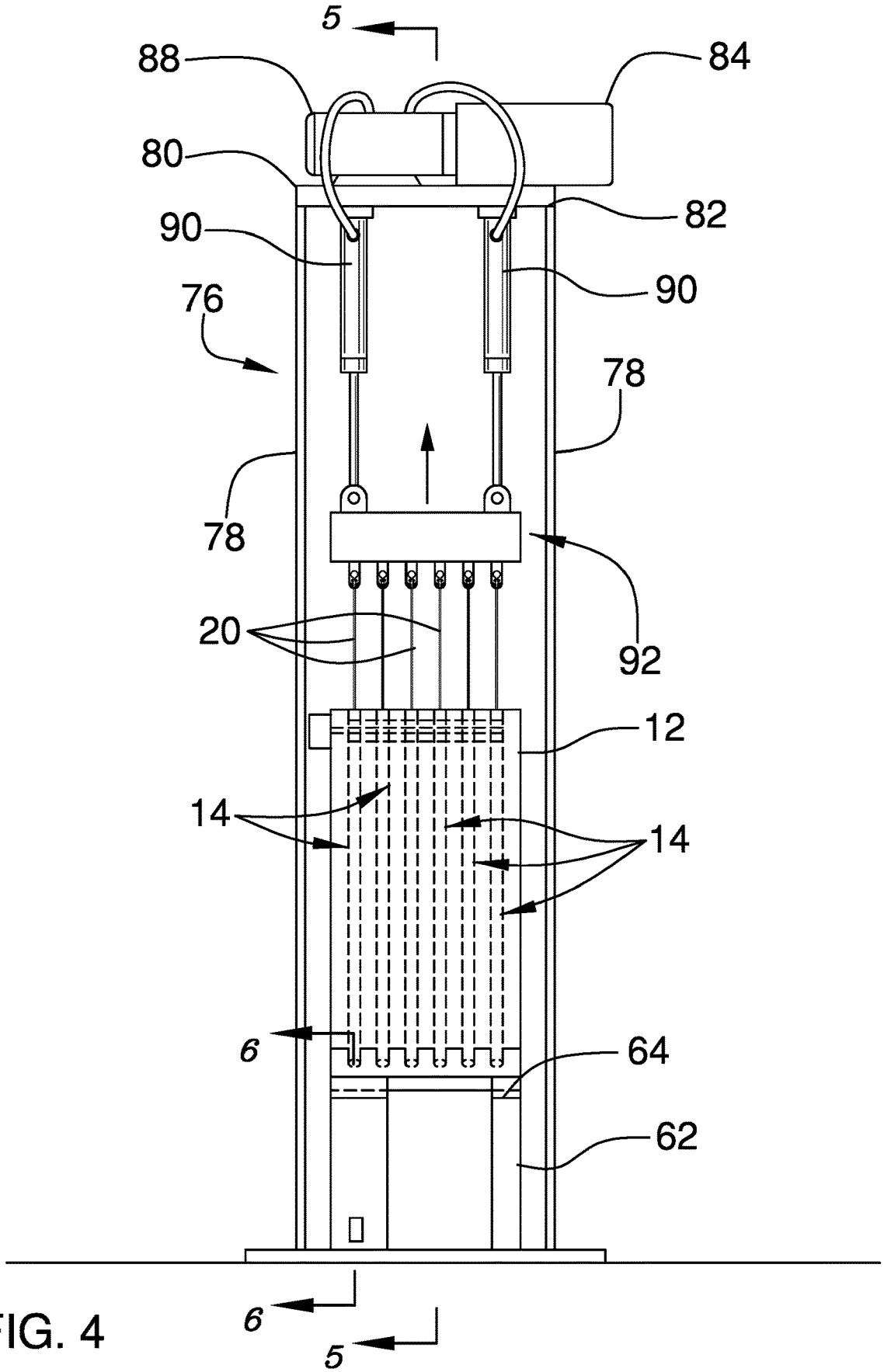
FIG. 4 is a front phantom view of an embodiment of the disclosure.
Figure 5:
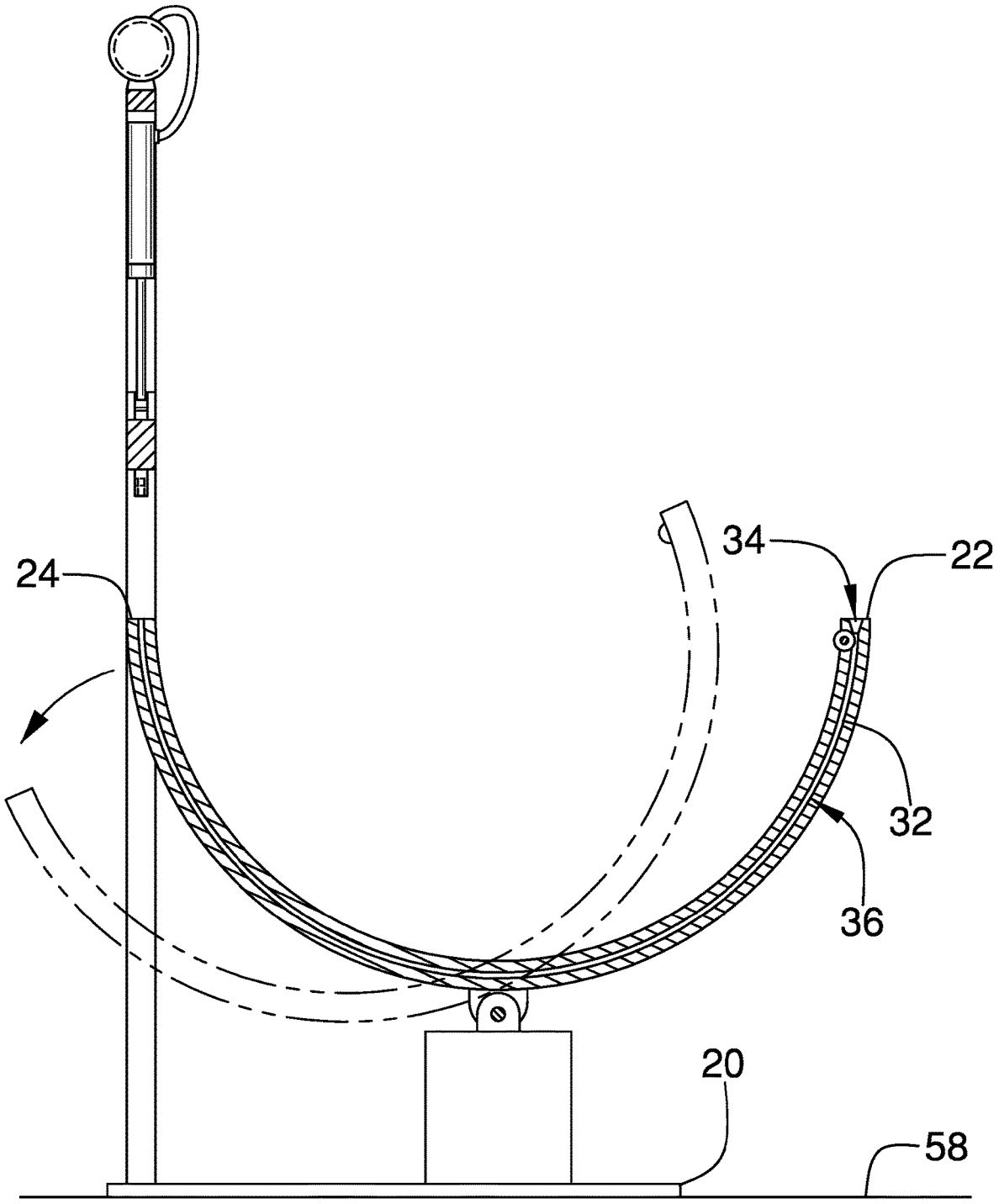
FIG. 5 is a cross sectional view taken along line 5-5 of FIG. 4 of an embodiment of the disclosure.
Figure 6:
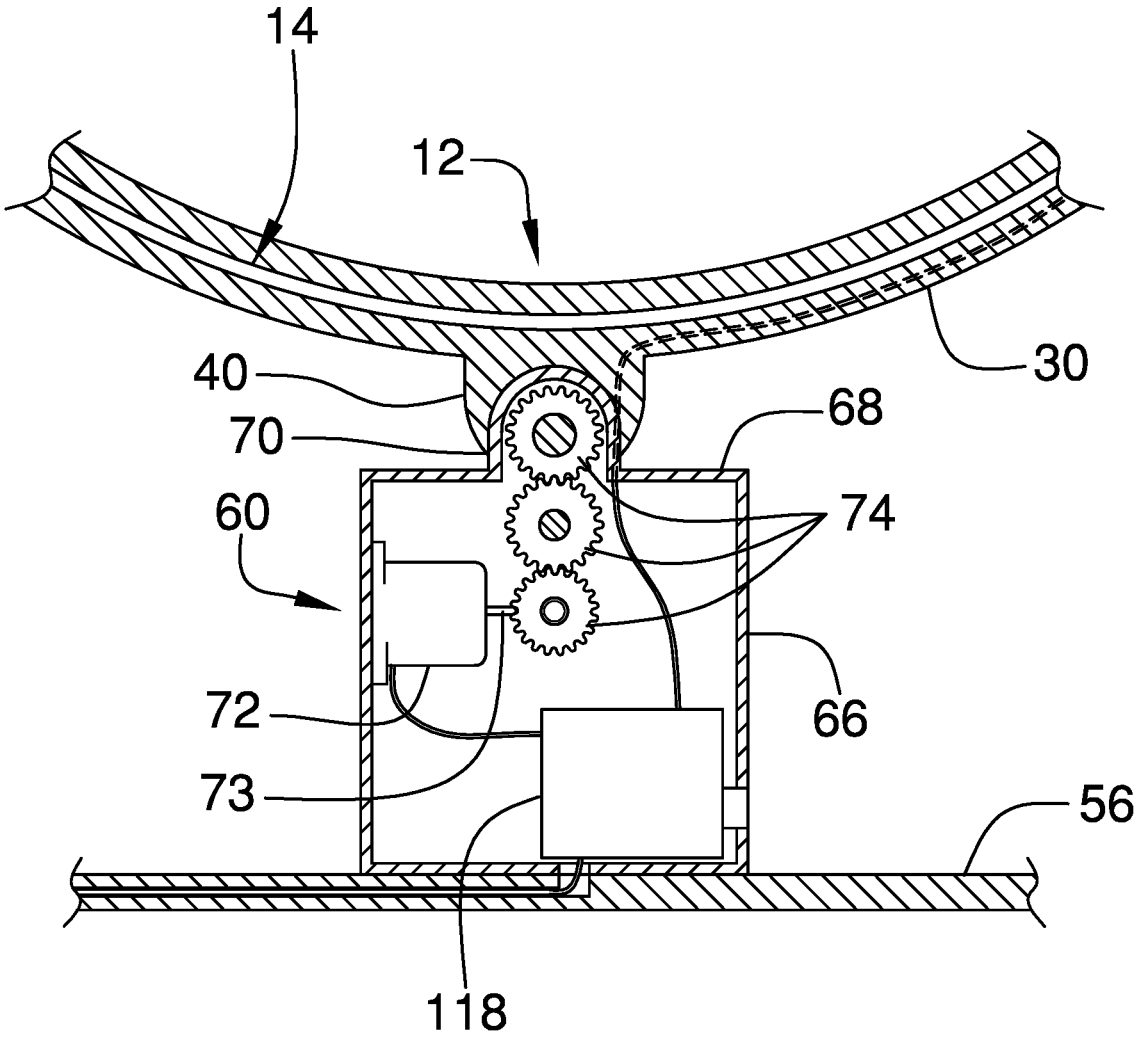
FIG. 6 is a cross sectional view taken along line 6-6 of FIG. 4 of an embodiment of the disclosure.
Figure 7:
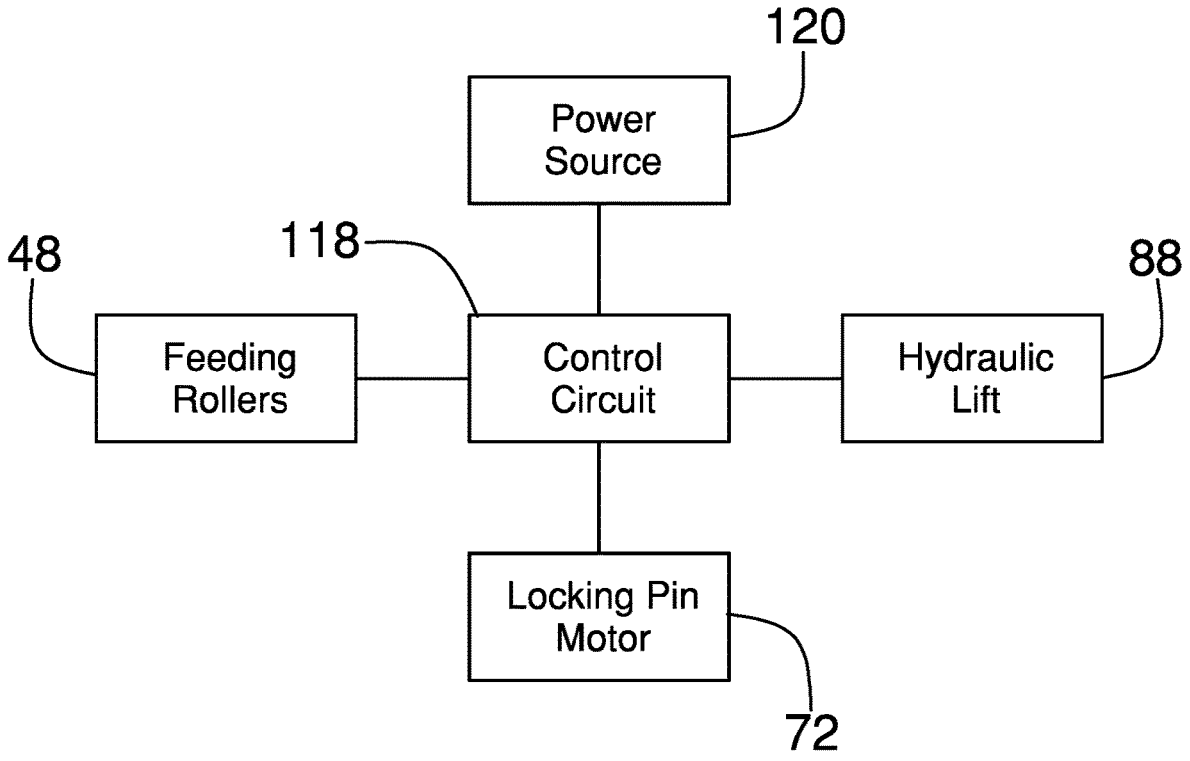
FIG. 7 is a schematic view of an embodiment of the disclosure.

With reference now to the drawings, and in particular to FIGS. 1 through 7 thereof, a new stretching device embodying the principles and concepts of an embodiment of the disclosure and generally designated by the reference numeral 10 will be described.

As best illustrated in FIGS. 1 through 7, the instrument string stretching assembly 10 generally comprises a curved panel 12 that has a plurality of channels 14 each extending through the curved panel 12 such that each of the plurality of channels 14 follows curvature of the curved panel 12. The curved panel 12 is positioned in an instrument string manufacturing facility. Each of the plurality of channels 14 has an entry 16 and an exit 18 and the curved panel 12 is oriented such that each of the entry 16 and the exit 18 of each of the plurality of channels 14 is directed upwardly. In this way a plurality of instrument strings 20 can be inserted in to the entry 16 of a respective one of the channels 14 having each of the instrument strings 20 extending outwardly through the exit 18 of the respective channel 14. Furthermore, the curved panel 12 may be located in a production line that includes a variety of machines that are commonly employed in the instrument string manufacturing industry.

The curved panel 12 has a first end 22, a second end 24 and an outer surface 26 extending between the first end 22 and the second end 24 and the outer surface 26 has a top side 28 and a bottom side 30. The top side 28 is concavely arcuate between the first end 22 and the second end 24 such that the curved panel 12 defines a U-shape. The bottom side 30 is co-arcuate with the top side 28 and each of the plurality of channels 14 is positioned between the top side 28 and the bottom side 30. The entry 16 of each of the channels 14 extends through the first end 22 of the panel and the exit 18 of each of the channels 14 extends through the second end 24 of the panel.

Each of the channels 14 has a bounding surface 32 and the bounding surface 32 of each of the channels 14 has a first section 34 and a second section 36. The first section 34 of the bounding surface 32 of each of the plurality of channels 14 extends from the first end 22 toward the second end 24. The second section 36 of the bounding surface 32 of each of the plurality of channels 14 extends between the first section 34 and the second end 24 of the curved panel 12. Furthermore, the first section 34 of the bounding surface 32 of each of the plurality of channels 14 tapers inwardly between the first end 22 of the curved panel 12 and the second section 36 of the bounding surface 32 of a respective one of the plurality of channels 14. Thus, the first section 34 associated with each of the channels 14 has a conical shape thereby enhancing a ball end 38 of each of the instrument strings 20 to pass into the entry 16 of the respective channel 14.

A pair of pivots 40 is each coupled to and extends downwardly from the bottom side 30 of the outer surface 26 of the curved panel 12. Each of the pivots 40 is centrally positioned between the first end 22 and the second end 24 of the curved panel 12. Additionally, each of the pivots 40 is aligned with a line extending between a first lateral side 42 and a second lateral side 44 of the curved panel 12.

A roller unit 46 is rotatably integrated into the curved panel 12 and the roller unit 46 is positioned adjacent to the entry 16 of the plurality of channels 14. The roller unit 46 engages each of the plurality of instrument strings 20 as each of the plurality of instrument strings 20 passes into the entry 16 of the respective channel 14. The roller unit 46 urges the plurality of instrument strings 20 to travel through the respective channel 14 and outwardly through the exit 18 of the respective channel 14. The roller unit 46 comprises a roller motor 48 that is mounted to the curved panel 12 and the roller motor 48 has an output shaft 50 extending laterally across the top side 28 of the outer surface 26 of the curved panel 12. Additionally, the output shaft 50 is located adjacent to the first end 22 of the curved panel 12 and the roller motor 48 may comprise an electric motor or the like.

The roller unit 46 includes a plurality of rollers 52 and each of the plurality of rollers 52 is attached to the output shaft 50. The rollers 52 are spaced apart from each other and are evenly distributed along the output shaft 50. Each of the rollers 52 extends through the top side 28 of the outer surface 26 of the curved panel 12 such that each of the rollers 52 extends into a respective one of the channels 14. Moreover, an outside surface 54 of each of the rollers 52 frictionally engages the instrument string 20 in the respective channel 14 such that each of the rollers 52 urges the instrument string 20 in the respective channel 14 to travel through the respective channel 14 when the roller motor 48 is turned on.

A base 56 is positioned on a support surface 58 in the instrument string manufacturing facility and the base 56 has a top side 28. A pivot unit 60 is attached to the base 56 and the curved panel 12 is attached to the pivot unit 60 such that the curved panel 12 is spaced from the base 56. The pivot unit 60 pivots the curved panel 12 between a first position and a second position. The pivot unit 60 comprises a member 62 that is coupled to and extends upwardly from the top side 28 of the base 56. The member 62 has an upper end 64 that is pivotally attached to a respective one of the pivots 40 on the bottom side 30 of the outer surface 26 of the curved panel 12 such that the curved panel 12 is pivotally attached to the member 62.

The pivot unit 60 includes a pivot housing 66 that is coupled to and extends upwardly from the top side 28 of the base 56. The pivot housing 66 has a top end 68 and the pivot housing 66 has a lobe 70 extending upwardly from the top end 68. The lobe 70 receives a respective one of the pivots 40 on the bottom side 30 of the outer surface 26 of the curved panel 12. The pivot unit 60 includes a pivot motor 72 that is positioned within the pivot housing 66. The pivot motor 72 rotates in a first direction or a second direction when the pivot motor 72 is turned on and the pivot motor 72 has an output shaft 73. The pivot motor 72 may comprise a two direction electric motor or the like.

The pivot unit 60 includes a series of gears 74 that is each rotatably disposed within the pivot housing 66. The output shaft 73 of the pivot motor 72 is engaged to a respective one of the series of gears 74 thereby facilitating the pivot motor 72 to rotate the series of gears 74 when the pivot motor 72 is turned on. A respective one of the series of gears 74 is positioned in the lobe 70 and the respective gear 74 that is positioned in the lobe 70 engages the pivot 40 associated with the curved panel 12 that is positioned in the lobe 70. The curved panel 12 is pivoted into the first position when the pivot motor 72 rotates in the first direction and the curved panel 12 is pivoted into the second position when the pivot motor 72 rotates in the second direction.

A stretching unit 76 is attached to the base 56 such that the stretching unit 76 is vertically oriented on the base 56. The stretching unit 76 is aligned with the exit 18 of each of the plurality of channels 14 in the curved panel 12. Additionally, the stretching unit 76 is actuatable into a lifting condition or a lowering condition. The stretching unit 76 comprises a pair of stanchions 78 that is each coupled to and extends upwardly from the top side 28 of the base 56. Each of the stanchions 78 is positioned on opposite sides of the curved panel 12 with respect to each other and each of the stanchions 78 is positioned adjacent to the second end 24 of the curved panel 12. The stretching unit 76 includes a top member 80 that is coupled to a top end 82 of each of the stanchions 78 such that the top member 80 extends between the pair of stanchions 78.

The stretching unit 76 includes a hydraulic reservoir 84 that is attached to the top member 80 and the hydraulic reservoir 84 contains a hydraulic fluid 86. The stretching unit 76 includes a hydraulic pump 88 that is attached to the top member 80. The hydraulic pump 88 is fluidly coupled to the hydraulic reservoir 84 such that the hydraulic pump 88 receives the hydraulic fluid 86 from the hydraulic reservoir 84. Furthermore, the hydraulic pump 88 may comprise an electric fluid pump commonly associated with hydraulic systems.

The stretching unit 76 includes a pair of hydraulic pistons 90 and each of the hydraulic pistons 90 is coupled to and extends downwardly from the top member 80. Each of the hydraulic pistons 90 is fluidly coupled to the hydraulic pump 88 such that each of the hydraulic pistons 90 receives the hydraulic fluid 86 from the hydraulic pump 88. Additionally, each of the hydraulic pistons 90 is lengthened when hydraulic pump 88 is actuated to pump the hydraulic fluid 86 into the hydraulic pistons 90. Each of the hydraulic pistons 90 is shortened when the hydraulic pump 88 is actuated to pump the hydraulic fluid 86 out of the hydraulic pistons 90.

A clamping unit 92 is attached to the stretching unit 76 such that the clamping unit 92 is aligned with the exit 18 of each of the channels 14 in the curved panel 12. The clamping unit 92 grips the ball end 38 of each of the plurality of instrument strings 20. The stretching unit 76 lifts the clamping unit 92 upwardly when the clamping unit 92 grips the ball end 38 of the instrument strings 20 and the stretching unit 76 is actuated into the lifting condition. In way the instrument strings 20 are stretched along the plurality of channels 14 in the curved panel 12. Furthermore, the curved panel 12 facilitates stretching force of the stretching unit 76 to be evenly distributed over a full length of the instrument strings 20 thereby increasing performance of the instrument strings 20 with respect to staying in tune when the instrument strings 20 are installed on a guitar. In this way the process of stretching instrument strings 20 is improved with respect to the current method of stretching guitar stings in a linear fashion which can often result in tension being unevenly distributed along the instrument strings 20.

The clamping unit 92 comprises a block 94 that has an upper side 96 and a lower side 98. The block 94 has a pair of pivots 100 each disposed on the upper side 96. Each of the pivots 100 on the upper side 96 is pivotally attached to a lower end 102 of a respective one of the hydraulic pistons 90. A plurality of clamps 104 is each disposed on the lower side 98 of the block 94 and each of the clamps 104 has a front surface 106, a back surface 108 and a distal end 110 with respect to the lower side 98 of the block 94. Each of the clamps 104 has a first hole 112 extending through the front surface 106 and the back surface 108 and each of the clamps 104 has a second hole 114 extending through the front surface 106 and the back surface 108. The first hole 112 in each of the clamps 104 is spaced from the lower side 98 of the block 94 and the second hole 114 in each of the clamps 104 is spaced from the first hole 112. Furthermore, the first hole 112 in each of the clamps 104 has a diameter that is greater than a diameter of the second hole 114 in each of the clamps 104.

Each of the clamps 104 has a slot 116 extending through the front surface 106 and the back surface 108 and the slot 116 in each of the clamps 104 extends through the first hole 112 and the second hole 114 and the distal end 110. In this way the first hole 112 in each of the clamps 104 can insertably receive the ball end 38 of a respective one of the instrument strings 20 having the respective instrument string 20 being positioned in the slot 116. Thus, the ball end 38 of the respective instrument string 20 can be secured in the respective clamp 104 when the hydraulic pistons 90 lift the block 94 to facilitate the instrument strings 20 to be stretched.

A control unit 118 is positioned in the pivot housing 66 and the control unit 118 is electrically coupled to the roller motor 48, the pivot motor 72 and the hydraulic pump 88. The control unit 118 is electrically coupled to a power source 120 comprising an electrical system of the instrument string manufacturing facility. Additionally, the control unit 118 is electrically coupled to the various machines in the instrument string manufacturing facility. In this way the roller motor 48, the pivot motor 72 and the hydraulic pump 88 can be operated in conjunction with the various machines in the instrument string manufacturing facility. Thus, the process of stretching the instrument strings 20 can be integrated into the automated process of manufacturing the instrument strings 20.

In use, the roller unit 46 is turned on the when plurality of instrument strings 20 are inserted into the entry 16 of the channels 14 thereby facilitating the instrument strings 20 to travel fully through the channels 14. The ball end 38 of each of the instrument strings 20 is positioned in the first hole 112 in each of the clamps 104 and the stretching unit 76 is actuated into the lifting condition to stretch the instrument strings 20. In this way the instrument strings 20 are stretched along the curvature of the channels 14 thereby facilitating the tension in the instrument strings 20 to be evenly distributed along the instrument strings 20. Furthermore, the stretching unit 76 applies a pre-determined force on the instrument strings 20 that has been determined to be the optimal force for stretching the instrument strings 20. The stretching 76 unit is actuated into the lowering condition to facilitate the ball end 38 of the instrument strings 20 to be released from the clamps 104 and the pivot unit 60 pivots the curved panel 12 in the second position to facilitate the instrument strings 20 to be removed from the curved panel 12 for packaging.

The process of hand stretching instrument strings 20 when they are installed on a stringed instrument generally involves pulling the instrument strings 20 upwardly along the neck of the stringed instrument. This process of manually lifting the instrument strings 20 can cause damage to parts of the stringed instrument, including but not being limited to, the bridge, the bridge plate, bridge pins and top braces. The process of stretching the instrument strings 20 during the manufacturing process as is described in the application eliminates the need for the instrument strings 20 to be hand stretched once they are installed on the stringed instrument. In this way the potential damage to the stringed instrument that can result from hand stretching the instrument strings 20 is eliminated. Furthermore, the instrument strings 20 can potentially vibrate approximately 25.0 percent more than they would otherwise, thereby enhancing the resonant performance of the stringed instrument as well as facilitating the instrument strings 20 to stay in tune. Furthermore, the manufacturing process might involve heating the instrument strings 20 prior to being stretched in the curved panel 12 to impart a memory into the instrument strings 20 thereby inhibiting the instrument strings 20 from shrinking prior to being installed on the stringed instrument.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A instrument string stretching assembly for stretching instrument string during the manufacturing process, said assembly comprising:

a curved panel having a plurality of channels each extending through said curved panel such that each of said plurality of channels follows curvature of said curved panel, said curved panel being positioned in a instrument string manufacturing facility, each of said plurality of channels having an entry and an exit, said curved panel being oriented such that each of said entry and said exit of each of said plurality of channels is directed upwardly thereby facilitating a plurality of instrument strings to be inserted in to said entry of a respective one of said channels having each of said instrument strings extending outwardly through said exit of said respective channel;

a roller unit being rotatably integrated into said curved panel, said roller unit being positioned adjacent to said entry of said plurality of channels, said roller unit engaging each of the plurality of instrument strings as each of the plurality of instrument strings passes into said entry of said respective channel thereby facilitating said roller unit to urge the plurality of instrument strings to travel through said respective channel and outwardly through said exit of said respective channel;

a pivot unit being attached to said base, said curved panel being attached to said pivot unit such that said curved panel is spaced from said base, said pivot unit pivoting said curved panel between a first position and a second position;

a stretching unit being attached to said base such that said stretching unit is vertically oriented on said base, said stretching unit being aligned with said exit of each of said plurality of channels in said curved panel, said stretching unit being actuatable into a lifting condition or a lowering condition; and a clamping unit being attached to said stretching unit such that said clamping unit is aligned with said exit of each of said channels in said curved panel, said clamping unit gripping the ball end of each of the plurality of instrument strings, said stretching unit lifting said clamping unit upwardly when said clamping unit grips the ball end of the instrument strings and said stretching unit is actuated into said lifting condition thereby stretching the instrument strings along said plurality of channels in said curved panel, said curved panel facilitating stretching force of said stretching unit to be evenly distributed over a full length of the instrument strings thereby increasing performance of the instrument strings with respect to staying in tune when the instrument strings are installed on a guitar.

2. The assembly according to claim 1, wherein:

said curved panel has a first end, a second end and an outer surface extending between said first end and said second end, said outer surface having a top side and a bottom side, said top side being concavely arcuate between said first end and said second end such that said curved panel defines a U-shape, said bottom side being co-arcuate with said top side, each of said plurality of channels being positioned between said top side and said bottom side, said entry of each of said channels extending through said first end of said panel, said exit of each of said channels extending through said second end of said panel;

each of said channels has a bounding surface, said bounding surface of each of said channels having a first section and a second section, said first section of said bounding surface of each of said plurality of channels extending from said first end toward said second end, said second section of said bounding surface of each of said plurality of channels extending between said first section and said second end of said curved panel, said first section of said bounding surface of each of said plurality of channels tapering inwardly between said first end of said curved panel and said second section of said bounding surface of a respective one of said plurality of channels such that said first section associated with each of said channels has a conical shape thereby enhancing a ball end of each of the instrument strings to pass into said entry of said respective channel; and said assembly includes a pair of pivots, each of said pivots being coupled to and extending downwardly from said bottom side of said outer surface of said curved panel, each of said pivots being centrally positioned between said first end and said second end of said curved panel, each of said pivots being aligned with an line extending between a first lateral side and a second lateral side of said curved panel.

3. The assembly according to claim 2, wherein said roller unit comprises:

a roller motor being mounted to said curved panel, said roller motor having an output shaft extending laterally across said top side of said outer surface of said curved panel, said output shaft being located adjacent to said first end of said curved panel; and a plurality of rollers, each of said rollers being attached to said output shaft, said plurality of rollers being spaced apart from each other and being evenly distributed along said output shaft, each of said rollers extending through said top side of said outer surface of said curved panel such that each of said rollers extends into a respective one of said channels, an outside surface of each of said rollers frictionally engaging the instrument string in said respective channel such that each of said rollers urges the instrument string in said respective channel to travel through said respective channel when said roller motor is turned on.

4. The assembly according to claim 2, wherein:

said assembly includes a base being positioned on a support surface in the instrument string manufacturing facility, said base having a top side; and said pivot unit comprises:

a member being coupled to and extending upwardly from said top side of said base, said member having an upper end being pivotally attached to a respective one of said pivots on said bottom side of said outer surface of said curved panel such that said curved panel is pivotally attached to said member;

a pivot housing being coupled to and extending upwardly from said top side of said base, said pivot housing having a top end, said pivot housing having a lobe extending upwardly from said top end, said lobe receiving a respective one of said pivots on said bottom side of said outer surface of said curved panel;

a pivot motor being positioned within said pivot housing, said pivot motor rotating in a first direction or a second direction when said pivot motor is turned on, said pivot motor having an output shaft; and a series of gears, each of said series of gears being rotatably disposed within said pivot housing, said output shaft of said pivot motor being engaged to a respective one of said series of gears thereby facilitating said pivot motor to rotate said series of gears when said pivot motor is turned on, a respective one of said series of gears being positioned in said lobe, said respective gear that is positioned in said lobe engaging said pivot associated with said curved panel that is positioned in said lobe, said curved panel being pivoted into said first position when said pivot motor rotates in said first direction, said curved panel being pivoted into said second position when said pivot motor rotates in said second direction.

5. The assembly according to claim 1, wherein:

said assembly includes a base being positioned on a support surface in the instrument string manufacturing facility, said base having a top side; and said stretching unit comprises:

a pair of stanchions, each of said stanchions being coupled to and extending upwardly from said top side of said base, each of said stanchions being positioned on opposite sides of said curve panel with respect to each other, each of said stanchions being positioned adjacent to said second end of said curved panel;

a top member being coupled to a top end of each of said stanchions such that said top member extends between said pair of stanchions;

a hydraulic reservoir being attached to said top member, said hydraulic reservoir containing a hydraulic fluid;

a hydraulic pump being attached to said top member, said hydraulic pump being fluidly coupled to said hydraulic reservoir such that said hydraulic pump receives the hydraulic fluid from said hydraulic reservoir; and a pair of hydraulic pistons, each of said hydraulic pistons being coupled to and extending downwardly from said top member, each of said hydraulic pistons being fluidly coupled to said hydraulic pump such that each of said hydraulic pistons receives the hydraulic fluid from said hydraulic pump, each of said hydraulic pistons being lengthened when hydraulic pump is actuated to pump the hydraulic fluid into said hydraulic pistons, each of said hydraulic pistons being shortened when said hydraulic pump is actuated to pump the hydraulic fluid out of said hydraulic pistons.

6. The assembly according to claim 5, wherein said clamping unit comprises:

a block having an upper side and a lower side, said block having a pair of pivots each being disposed on said upper side, each of said pivots on said upper side being pivotally attached to a lower end of a respective one of said hydraulic pistons; and a plurality of clamps, each of said clamps being disposed on said lower side of said block, each of said clamps comprising having a front surface, and a back surface and a distal end with respect to said lower side of said block.

7. The assembly according to claim 6, wherein:

each of said clamps has a first hole extending through said front surface and said back surface;

each of said clamps has a second hole extending through said front surface and said back surface, said first hole in each of said clamps being spaced from said lower surface of said block, said second hole in each of said clamps being spaced from said first hole;

said first hole in each of said clamps has a diameter being greater than a diameter of said second hole in each of said clamps; and each of said clamps has a slot extending through said front surface and said back surface, said slot in each of said clamps extending through said first hole and said second hole and said distal end thereby facilitating said first hole in each of said clamps to insertably receive the ball end of a respective one of the instrument strings having the respective instrument string being positioned in said slot thereby facilitating the ball end of the respective instrument string to be secured in said clamp when said hydraulic pistons lift said block to facilitate the instrument strings to be stretched.

8. The assembly according to claim 1, wherein:

said roller unit includes a roller motor;

said pivot unit includes a pivot housing and a pivot motor being disposed in said pivot housing;

said stretching unit includes a hydraulic pump; and said assembly includes a control unit being positioned in said pivot housing, said control unit being electrically coupled to said roller motor and said pivot motor and said hydraulic pump, said control unit being electrically coupled to a power source comprising an electrical system of the instrument string manufacturing facility.

9. A instrument string stretching assembly for stretching instrument string during the manufacturing process, said assembly comprising:

a curved panel having a plurality of channels each extending through said curved panel such that each of said plurality of channels follows curvature of said curved panel, said curved panel being positioned in a instrument string manufacturing facility, each of said plurality of channels having an entry and an exit, said curved panel being oriented such that each of said entry and said exit of each of said plurality of channels is directed upwardly thereby facilitating a plurality of instrument strings to be inserted in to said entry of a respective one of said channels having each of said instrument strings extending outwardly through said exit of said respective channel, said curved panel having a first end, a second end and an outer surface extending between said first end and said second end, said outer surface having a top side and a bottom side, said top side being concavely arcuate between said first end and said second end such that said curved panel defines a U-shape, said bottom side being co-arcuate with said top side, each of said plurality of channels being positioned between said top side and said bottom side, said entry of each of said channels extending through said first end of said panel, said exit of each of said channels extending through said second end of said panel, each of said channels having a bounding surface, said bounding surface of each of said channels having a first section and a second section, said first section of said bounding surface of each of said plurality of channels extending from said first end toward said second end, said second section of said bounding surface of each of said plurality of channels extending between said first section and said second end of said curved panel, said first section of said bounding surface of each of said plurality of channels tapering inwardly between said first end of said curved panel and said second section of said bounding surface of a respective one of said plurality of channels such that said first section associated with each of said channels has a conical shape thereby enhancing a ball end of each of the instrument strings to pass into said entry of said respective channel;

a pair of pivots, each of said pivots being coupled to and extending downwardly from said bottom side of said outer surface of said curved panel, each of said pivots being centrally positioned between said first end and said second end of said curved panel, each of said pivots being aligned with an line extending between a first lateral side and a second lateral side of said curved panel;

a roller unit being rotatably integrated into said curved panel, said roller unit being positioned adjacent to said entry of said plurality of channels, said roller unit engaging each of the plurality of instrument strings as each of the plurality of instrument strings passes into said entry of said respective channel thereby facilitating said roller unit to urge the plurality of instrument strings to travel through said respective channel and outwardly through said exit of said respective channel, said roller unit comprising:

a roller motor being mounted to said curved panel, said roller motor having an output shaft extending laterally across said top side of said outer surface of said curved panel, said output shaft being located adjacent to said first end of said curved panel; and a plurality of rollers, each of said rollers being attached to said output shaft, said plurality of rollers being spaced apart from each other and being evenly distributed along said output shaft, each of said rollers extending through said top side of said outer surface of said curved panel such that each of said rollers extends into a respective one of said channels, an outside surface of each of said rollers frictionally engaging the instrument string in said respective channel such that each of said rollers urges the instrument string in said respective channel to travel through said respective channel when said roller motor is turned on;

a base being positioned on a support surface in the instrument string manufacturing facility, said base having a top side;

a pivot unit being attached to said base, said curved panel being attached to said pivot unit such that said curved panel is spaced from said base, said pivot unit pivoting said curved panel between a first position and a second position, said pivot unit comprising:

a member being coupled to and extending upwardly from said top side of said base, said member having an upper end being pivotally attached to a respective one of said pivots on said bottom side of said outer surface of said curved panel such that said curved panel is pivotally attached to said member;

a pivot housing being coupled to and extending upwardly from said top side of said base, said pivot housing having a top end, said pivot housing having a lobe extending upwardly from said top end, said lobe receiving a respective one of said pivots on said bottom side of said outer surface of said curved panel;

a pivot motor being positioned within said pivot housing, said pivot motor rotating in a first direction or a second direction when said pivot motor is turned on, said pivot motor having an output shaft; and a series of gears, each of said series of gears being rotatably disposed within said pivot housing, said output shaft of said pivot motor being engaged to a respective one of said series of gears thereby facilitating said pivot motor to rotate said series of gears when said pivot motor is turned on, a respective one of said series of gears being positioned in said lobe, said respective gear that is positioned in said lobe engaging said pivot associated with said curved panel that is positioned in said lobe, said curved panel being pivoted into said first position when said pivot motor rotates in said first direction, said curved panel being pivoted into said second position when said pivot motor rotates in said second direction;

a stretching unit being attached to said base such that said stretching unit is vertically oriented on said base, said stretching unit being aligned with said exit of each of said plurality of channels in said curved panel, said stretching unit being actuatable into a lifting condition or a lowering condition, said stretching unit comprising:

a pair of stanchions, each of said stanchions being coupled to and extending upwardly from said top side of said base, each of said stanchions being positioned on opposite sides of said curve panel with respect to each other, each of said stanchions being positioned adjacent to said second end of said curved panel;

a top member being coupled to a top end of each of said stanchions such that said top member extends between said pair of stanchions;

a hydraulic reservoir being attached to said top member, said hydraulic reservoir containing a hydraulic fluid;

a hydraulic pump being attached to said top member, said hydraulic pump being fluidly coupled to said hydraulic reservoir such that said hydraulic pump receives the hydraulic fluid from said hydraulic reservoir; and a pair of hydraulic pistons, each of said hydraulic pistons being coupled to and extending downwardly from said top member, each of said hydraulic pistons being fluidly coupled to said hydraulic pump such that each of said hydraulic pistons receives the hydraulic fluid from said hydraulic pump, each of said hydraulic pistons being lengthened when hydraulic pump is actuated to pump the hydraulic fluid into said hydraulic pistons, each of said hydraulic pistons being shortened when said hydraulic pump is actuated to pump the hydraulic fluid out of said hydraulic pistons;

a clamping unit being attached to said stretching unit such that said clamping unit is aligned with said exit of each of said channels in said curved panel, said clamping unit gripping the ball end of each of the plurality of instrument strings, said stretching unit lifting said clamping unit upwardly when said clamping unit grips the ball end of the instrument strings and said stretching unit is actuated into said lifting condition thereby stretching the instrument strings along said plurality of channels in said curved panel, said curved panel facilitating stretching force of said stretching unit to be evenly distributed over a full length of the instrument strings thereby increasing performance of the instrument strings with respect to staying in tune when the instrument strings are installed on a guitar, said clamping unit comprising:

a block having an upper side and a lower side, said block having a pair of pivots each being disposed on said upper side, each of said pivots on said upper side being pivotally attached to a lower end of a respective one of said hydraulic pistons; and a plurality of clamps, each of said clamps being disposed on said lower side of said block, each of said clamps comprising having a front surface, and a back surface and a distal end with respect to said lower side of said block, each of said clamps having a first hole extending through said front surface and said back surface, each of said clamps having a second hole extending through said front surface and said back surface, said first hole in each of said clamps being spaced from said lower surface of said block, said second hole in each of said clamps being spaced from said first hole, said first hole in each of said clamps having a diameter being greater than a diameter of said second hole in each of said clamps, each of said clamps having a slot extending through said front surface and said back surface, said slot in each of said clamps extending through said first hole and said second hole and said distal end thereby facilitating said first hole in each of said clamps to insertably receive the ball end of a respective one of the instrument strings having the respective instrument string being positioned in said slot thereby facilitating the ball end of the respective instrument string to be secured in said clamp when said hydraulic pistons lift said block to facilitate the instrument strings to be stretched; and a control unit being positioned in said pivot housing, said control unit being electrically coupled to said roller motor and said pivot motor and said hydraulic pump, said control unit being electrically coupled to a power source comprising an electrical system of the instrument string manufacturing facility.

* * * * *